US006511303B2

(12) United States Patent
Obara

(10) Patent No.: US 6,511,303 B2
(45) Date of Patent: Jan. 28, 2003

(54) FAN BLOWER WITH DURABLE BEARING STRUCTURE

(75) Inventor: Rikuro Obara, Miyota-machi (JP)

(73) Assignee: Minebea Kabushiki-Kaisha, Nagano-ken (JP)

( * ) Notice: Subject to any disclaimer, the term of this patent is extended or adjusted under 35 U.S.C. 154(b) by 0 days.

(21) Appl. No.: 09/893,876

(22) Filed: Jun. 29, 2001

(65) Prior Publication Data

US 2002/0009378 A1 Jan. 24, 2002

(30) Foreign Application Priority Data

Jul. 21, 2000 (JP) ..... 2000-220900

(51) Int. Cl.[7] ..... F04B 17/00
(52) U.S. Cl. ..... 417/423.12; 417/423.14
(58) Field of Search ..... 417/423.12, 423.14

(56) References Cited

U.S. PATENT DOCUMENTS 5,267,842 A * 12/1993 Harmsen et al. ..... 417/354
6,174,145 B1 * 1/2001 Taniguchi ..... 417/423.14
6,394,767 B1 * 5/2002 Matsumoto ..... 417/423.1

FOREIGN PATENT DOCUMENTS

JP 05248393 A * 9/1993

* cited by examiner

*Primary Examiner*—Charles G. Freay
*Assistant Examiner*—John F Belena
(74) *Attorney, Agent, or Firm*—Israel Gopstein

(57) ABSTRACT

The object of the present invention is to provide a blower including a bearing structure wherein the number of components is reduced, the cost for manufacturing can be reduced, and the diameter of the shaft can be increased. The bearing structure is good at its durability, eliminates or reduces the rotational run out, and provides superior quietness. The blower of the present invention having an impeller adapter to be rotated upon energizing the blower comprising; a bearing device for supporting a rotational center portion of the impeller, the bearing device including; a sleeve, a stepped shaft including a larger diameter portion and a reduced diameter portion provided at one end thereof, the first inner raceway groove formed at an appropriate position around the outer peripheral surface of the larger diameter portion, the first outer raceway groove formed on an inner peripheral surface of the sleeve so as to correspond with the first inner raceway groove, balls of the first row interposed between the first and second grooves an inner ring slidably fit over the reduced diameter portion, the second outer raceway groove formed on the inner peripheral surface of the inner ring, the second outer raceway groove formed on the inner peripheral surface of the sleeve so as to corrrespond with the second inner raceway groove, balls of the second row interposed between the second inner and outer raceway grooove, a stop ring provided around the inner periphery of the distal end of the reduced diameter portion, and a pre-loading spring interposed between the stop ring and an end surface of the inner ring to provide a suitable amount of pre-loading force to the inner ring.

15 Claims, 8 Drawing Sheets

FAN BLOWER WITH DURABLE BEARING STRUCTURE

BACKGROUND OF THE INVENTION

1. Technical Field

The present invention relates especially to a blower suitable in the application for cooling office automation equipment.

2. Description of the Prior Art

Conventionally, the double row bearing device employed in the blower for cooling the office automation equipment includes a pair of ball bearings 102 and 103 fit on a shaft 101 of the motor as shown in FIG. 8.

Inner rings 102*a*, 103*a* of each ball bearing 102, 103 are loose fit to the shaft 101, and outer rings 102*b*, 103*b* are also loose fit within the sleeve 104 being the bearing housing.

A compressed coil spring 106 for applying pre-load to both ball bearings is interposed between the outer surface of the inner ring 102*a* of the left ball bearing 102 disposed adjacent the yoke 105 and the front face plate 105*a* of the yoke 105 integrally connected to the front face plate 108*a* of the impeller 108. A stop ring 107 for retaining the ball bearing 103 is provided around the right end of the shaft 101 and secured thereto.

However, in the case of the pre-loading means as shown in FIG. 9, the clearance defined between the yoke 105 and the ball bearing 102 is very narrow, making it difficult to incorporate the compressed spring 106 into the clearance. Further, the necessity of incorporation of the spring into the clearance upon assembling the blower will make the assembling operation complicated. The level of the pre-loading force depends exclusively upon the distance between the yoke 105 and the bearing 102. Setting such distance is difficult and therefore, applying suitable amount of pre-loading force is difficult.

The sleeve 104 has at both ends thereof larger inner diameter portions 104*a*, 104*b* for accommodating the outer rings of the ball bearings. Each of the larger inner diameter portions includes a shoulder respectively to which the outer ring of the ball bearing will be abutted. When the larger inner diameter portions 104*a*, 104*b* are more or less eccentrically formed with respect to the sleeve, the rotational movement of the shaft is also effected eccentrically, and generates vibrations or noise and therefore a precise machining on the larger inner diameter portion is required.

As it can be seen from the above, the blower employing the double row bearing device of the prior art requires a pair of ball bearings including an inner and an outer ring. A complicated operation for inserting the pre-loading spring is required. This involves a high cost for manufacturing the bearing device.

The bigger the diameter of the motor shaft is, the higher is the rigidity of the shaft, and thus the rotational run out is reduced and a quiet motor with high durability can be obtained. However, the diameter of the shaft of the bearing device of the prior art is smaller than that of the sleeve by twice the sum of the thickness of the inner and outer rings of the ball bearings fit around the shaft. Therefore, it is difficult to provide durability, prevent rotational run out, and reduce generation of vibrations or noise.

Accordingly, the object of the present invention is to provide a blower including a bearing structure wherein the number of components is reduced, assembly is easy, manufacturing cost is reduced, and the diameter of the shaft is increased being good at its durability, further eliminating rotational run out and providing superior quietness.

SUMMARY OF THE INVENTION

These and other objects are achieved by a blower in accordance with the first aspect of the present invention having an impeller adapted to be rotated upon energizing the blower comprising;

- a bearing device for supporting a rotational center portion of the impeller, the bearing device including;
  - a sleeve,
  - a stepped shaft including a larger diameter portion and a reduced diameter portion provided at one end thereof,
  - the first inner raceway groove formed at an appropriate position around the outer peripheral surface of the larger diameter portion,
  - the first outer raceway groove formed on an inner peripheral surface of the sleeve so as to correspond with the first inner raceway groove,
  - balls of the first row interposed between the first and second grooves,
  - an inner ring slidably fit over the reduced diameter portion,
  - the second inner raceway groove formed around an outer peripheral surface of the inner ring,
  - the second outer raceway groove formed on the inner peripheral surface of the sleeve so as to correspond with the second inner raceway groove,
  - balls of the second row interposed between the second inner and outer grooves,
  - a stop ring provided around the inner periphery of the distal end of the reduced diameter portion, and
  - a pre-loading spring interposed between the stop ring and an end surface of the inner ring to provide a suitable amount of pre-loading force to the inner ring.

The blower in accordance with the second aspect of the present invention comprising;

- a frame including a base connected through stays to the frame so as to be positioned at the central portion of the frame,
- a cylindrical bearing holder formed integrally with the base to extend therefrom forwardly,
- a stator including an iron core and a coil and mounted on the exterior of the cylindrical bearing holder,
- an impeller including a front face plate, a flange formed over the outer periphery of the front face plate, and suitable numbers of blades provided on the outer periphery of the flange,
- a yoke including a front face plate to which the front face plate of the impeller is secured, a flange formed over the outer periphery of the front face plate, a magnet mounted on the flange, and
- a bearing device for supporting the central portion of the yoke through a shaft of the bearing device to which the central portion of the yoke is fit and secured thereto, the bearing device including;
  - a sleeve,
  - a stepped shaft including a larger diameter portion and a reduced diameter portion provided at one end thereof,
  - the first inner raceway groove formed at an appropriate position around the outer peripheral surface of the larger diameter portion,
  - the first outer raceway groove formed on an inner peripheral surface of the sleeve so as to correspond with the first inner raceway groove, balls of the first row interposed between the first and second grooves, an inner ring slidably fit over the reduced diameter portion, the second inner raceway groove formed around an outer peripheral surface of the inner ring, the second outer raceway groove formed on the inner peripheral surface of the sleeve so as to correspond with the second inner raceway groove, balls of the second row interposed between the third and fourth grooves, a stop ring provided around the inner periphery of the distal end of the reduced diameter portion, and a pre-loading spring interposed between the stop ring and an end surface of the inner ring to provide a suitable amount of pre-loading force to the inner ring.

The blower in accordance with the third aspect of the present invention comprising;

a frame including a base connected through stays to the frame so as to be positioned at the central portion of the frame, a cylindrical bearing holder formed integrally with the base to extend therefrom forwardly, a stator including an iron core and a coil and mounted on the exterior of the cylindrical bearing holder, an impeller including a front face plate, a flange formed over the outer periphery of the front face plate, and suitable numbers of blades provided on the outer periphery of the flange, a yoke including a front face plate to which the front face plate of the impeller is secured, a flange formed over the outer periphery of the front face plate, a magnet mounted on the flange, and a bearing device for supporting the central portion of the yoke through a sleeve of the bearing apparatus to which the central portion of the yoke is fit and secured thereto, the bearing device including;

a sleeve, a stepped shaft including a larger diameter portion and a reduced diameter portion provided at one end thereof, the first inner raceway groove formed at an appropriate position around the outer peripheral surface of the larger diameter portion, the first outer raceway groove formed on an inner peripheral surface of the sleeve so as to correspond with the first inner raceway groove, balls of the first row interposed between the first and second grooves, an inner ring slidably fit over the reduced diameter portion, the second inner raceway groove formed around an outer peripheral surface of the inner ring, the second outer raceway groove formed on the inner peripheral surface of the sleeve so as to correspond with the second inner raceway groove, balls of the second row interposed between the third and fourth grooves, a stop ring provided around the inner periphery of the distal end of the reduced diameter portion, and a pre-loading spring interposed between the stop ring and an end surface of the inner ring to provide a suitable amount of pre-loading force to the inner ring.

The blower in accordance with the fourth aspect of the present invention comprising;

a frame including a base connected through stays to the frame so as to be positioned at the central portion of the frame, a cylindrical bearing holder formed integrally with the base to extend therefrom forwardly, a stator including an iron core and a coil and mounted on the exterior of the cylindrical bearing holder, an impeller including a front face plate, a flange formed over the outer periphery of the front face plate, and suitable number of blades provided on the outer periphery of the flange, a yoke including a front face plate to which the front face plate of the impeller is secured, a flange formed over the outer periphery of the front face plate, a magnet mounted on the flange, and a bearing device for supporting the central portion of the yoke through a sleeve thereof to which the central portion of the yoke is fit and secured thereto, the bearing device including;

a sleeve, a stepped shaft including a larger diameter portion and a reduced diameter portion provided at one end thereof, the first inner raceway groove formed at an appropriate position around the outer peripheral surface of the larger diameter portion, the first outer raceway groove formed on an inner peripheral surface of the sleeve so as to correspond with the first inner raceway groove, balls of the first row interposed between the first and second grooves, an inner ring slidably fit over the reduced diameter portion, the second inner raceway groove formed around an outer peripheral surface of the inner ring, the second outer raceway groove formed on the inner peripheral surface of the sleeve so as to correspond with the second inner raceway groove, balls of the second row interposed between the third and fourth grooves, a stop ring provided around the inner periphery of the distal end of the reduced diameter portion, and a pre-loading spring interposed between the stop ring and an end surface of the inner ring to provide a suitable amount of pre-loading force to the inner ring, wherein the bearing device is provided within the cylindrical bearing holder so that the sleeve can be rotated around the axis of the bearing device, and the end of the shaft is secured to the base.

The blower in accordance with the fifth aspect of the present invention comprising;

a frame including a base connected through stays to the frame so as to be positioned at the central portion of the frame, a stator including an iron core and a coil and mounted on the inner peripheral surface of a flange extending forwardly from an outer periphery of the base, an impeller including a front face plate, a flange formed over the outer periphery of the front face plate, and suitable numbers of blades provided on the outer periphery of the flange, a bearing device for supporting the central portion of a supporting plate mounted on the rear surface of the front face plate, the bearing device including;

a sleeve to which the central portion of the supporting plate is fit and secured, a stepped shaft including a larger diameter portion and a reduced diameter portion provided at one end thereof, the first inner raceway groove formed at an appropriate position around the outer peripheral surface of the larger diameter portion, the first outer raceway groove formed on an inner peripheral surface of the sleeve so as to correspond with the first inner raceway groove, balls of the first row interposed between the first and second grooves, an inner ring slidably fit over the reduced diameter portion, the second inner raceway groove formed around an outer peripheral surface of the inner ring, the second outer raceway groove formed on the inner peripheral surface of the sleeve so as to correspond with the second inner raceway groove, balls of the second row interposed between the second inner and outer grooves, a stop ring provided around the inner periphery of the distal end of the reduced diameter portion, and a pre-loading spring interposed between the stop ring and an end surface of the inner ring to provide a suitable amount of pre-loading force to the inner ring, wherein the exterior of the sleeve of the bearing apparatus is provided with a cylindrical yoke on which a magnet corresponding to the coil of the stator is provided, and the end of the shaft is secured to the base.

In the blower in accordance with the sixth to the tenth aspect of the present invention, the balls for the first and second rows of any of the first to the fifth aspects of the present invention, are made of ceramic material.

In the blower in accordance with the eleventh to the fifteenth aspect of the present invention, the outer diameter of the inner ring of any of the first to the fifth aspects of the present invention are the same as that of the larger diameter portion of the shaft, and the diameter of the balls for the first row is the same as that of the balls for the second row.

BRIEF DESCRIPTION OF THE DRAWINGS

Further feature of the present invention will become apparent to those skilled in the art to which the present invention relates from reading the following specification with reference to the accompanying drawings, in which.

DETAILED DESCRIPTION OF THE PRESENT INVENTION

Preferred embodiments in accordance with the present invention will now be described with reference to the attached drawings.

The First Embodiment

Figure 1:
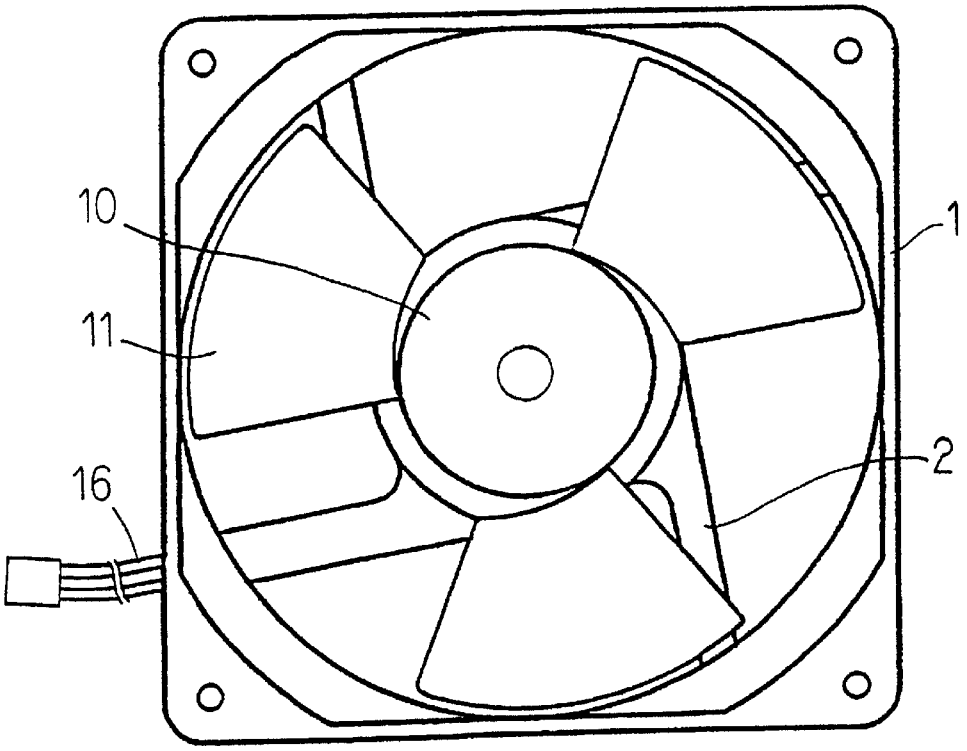
FIG. 1 is an elevational view showing the first embodiment of the blower in accordance with the present invention.
Figure 2:
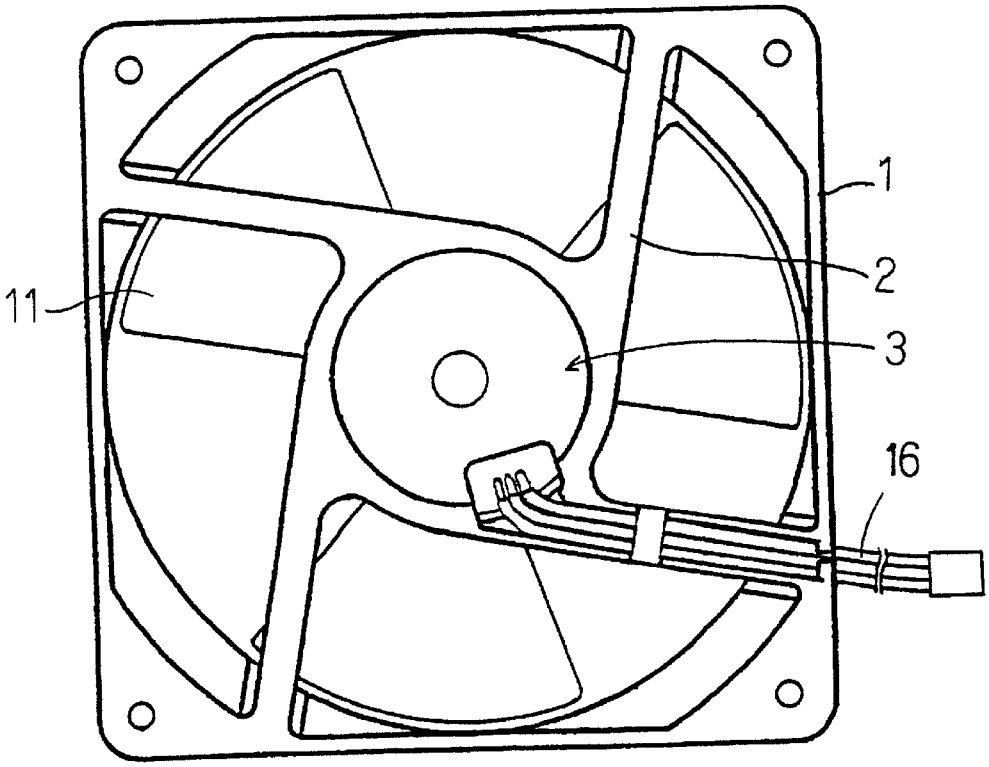
FIG. 2 is a rear elevational view showing the first embodiment of the blower in accordance with the present invention.

The blower in accordance with this embodiment is of a shaft rotating type. The frame of the body of the blower is designated by the reference numeral 1 in FIGS. 1–3. The frame is preferably made of synthetic resin.

A base 3 is supported through a few stays 2 by means of the frame formed integrally therewith. The outer periphery of the base 3 is formed with a flange 3*a* protruding frontward forming a relatively flat cylindrical configuration.

The base 3 also has a cylindrical bearing holder 4 protruding frontward formed integrally therewith. A stator 5 including an iron core 5*a* and coils 5*b* is provided around the exterior surface of the bearing holder 4. A sleeve 6 served as an outer ring of the bearing is secured by adhesive within the interior of the bearing holder 4.

A shaft 7 to be journalled through bearing means described hereinafter is disposed within the sleeve 6. At the distal end of the shaft protruding through the sleeve 6, a hub 8*c* for a central aperture provided through a front face plate 8*a* of a rotor or yoke 8 is fit and secured thereto.

The yoke 8 has at its outer periphery a flange 8*b* extending rearward, on the inner surface of which is provided with a magnet 9 corresponding to the stator 5.

The front face plate 8*a* of the yoke 8 is secured by any known means such as rivets 12 to a front face plate 10*a* of an impeller 10 having at its periphery a flange 10*b* extending rearward. The impeller 10 includes suitable number of blades 11 attached to the outer periphery of the flange.

The reference numeral 13 is added to a printed circuit board connected at its terminals to the coil of the stator. The printed circuit board is secured to the iron core holder 14 of the stator by means of machine screws 15. The reference numeral 16 is added to leads to the printed circuit board, and the reference numeral 17 is added to a space in which electrical components are to be accommodated.

The reference numeral 18 is added to a dust proof washer of resinous material fit around the outer periphery of the shaft 7. The washer serves to prevent the dusts from immigrating through the clearance defined between the sleeve 6 and the shaft 7 into the bearing device.

In the blower of the above mentioned arrangement, energizing the coil of the stator rotates the yoke 8, and thus the impeller 10 connected to the yoke to provide a blow of wind by the blades 11.

Hence, the present invention relates especially to the structure of the bearing apparatus for journaling the shaft. The structure of the bearing device will now be described in detail with reference to FIG. 4.

The shaft 7 is a stepped shaft including a larger diameter portion 7*a* and a reduced diameter portion 7*b* provided at one end of the shaft. The first inner raceway groove 19*a* is formed around the outer periphery of the larger diameter portion at a suitable position. The first outer raceway groove 19*b* is formed on the inner peripheral surface of said sleeve 6 so as to be positioned opposite to the first inner raceway groove 19*a*. A plurality of balls 20*a* of metallic or ceramic material for the first row are interposed between both grooves 19*a*, 19*b*.

An inner ring 21 of the same outer diameter as that of the larger diameter portion of the shaft is fit slidably over the reduced diameter portion 7*b* of the shaft. The second inner raceway groove 22*a* is formed around the outer peripheral surface of the inner ring. The second outer raceway groove 22*b* is formed on the inner peripheral surface of said sleeve so as to be positioned opposite to the second inner raceway groove 22*a*. A plurality of balls 20*b* of steel or ceramic material for the second row are interposed between both grooves 22*a*, 22*b*.

Figure 3:
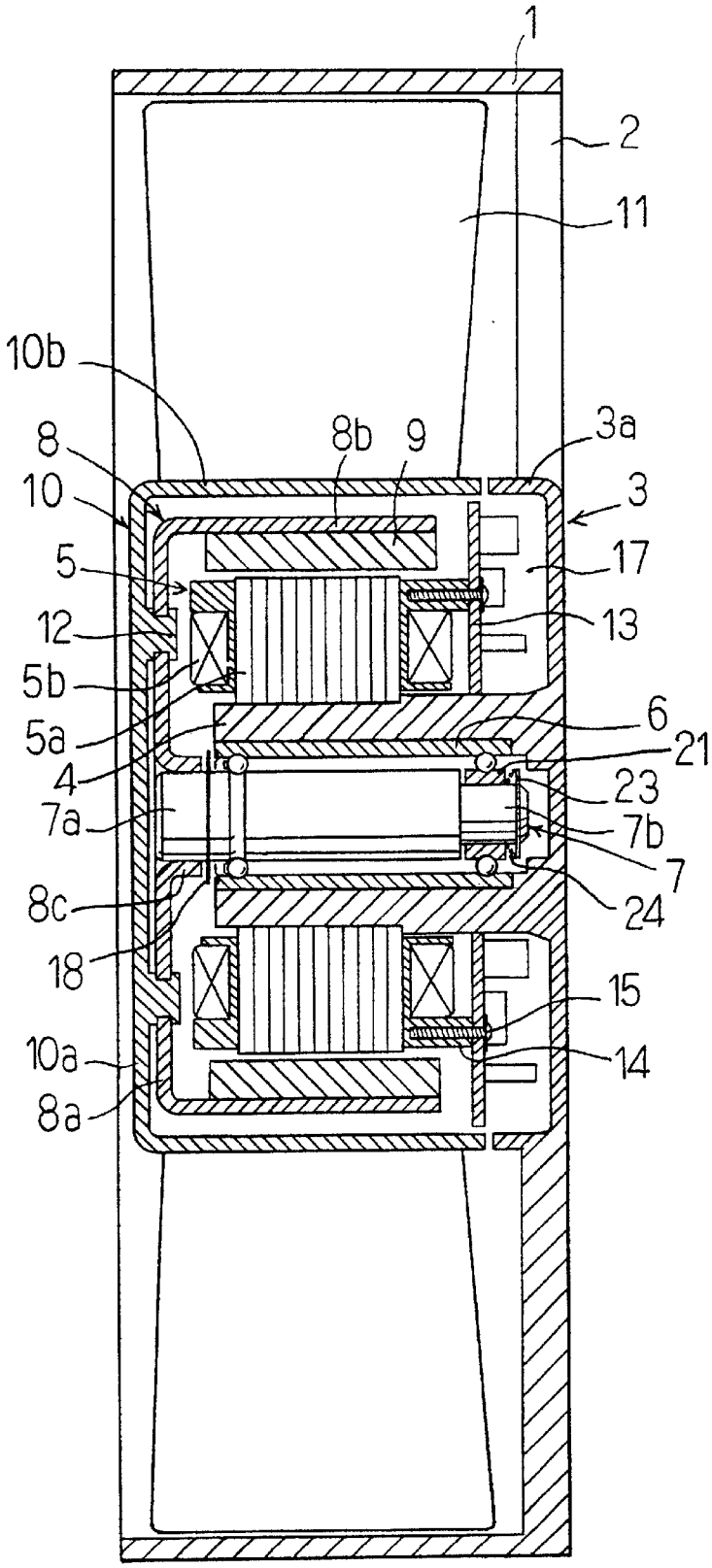
FIG. 3 is a longitudinal sectional view showing the first embodiment of the blower in accordance with the present invention.
Figure 4:
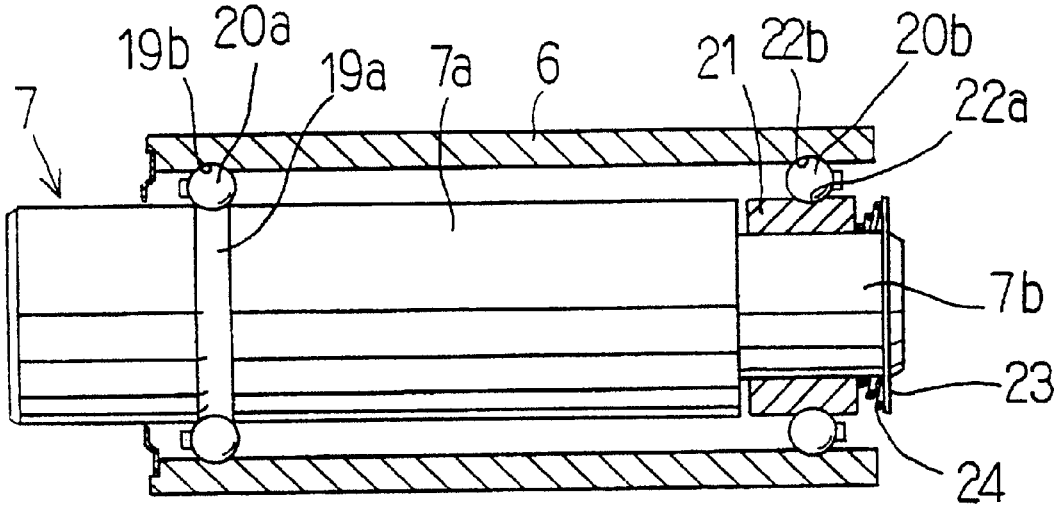
FIG. 4 is an enlarged cross-sectional view showing the bearing device of the blower in accordance with the present invention.

A stop ring 23 is provided around the outer periphery of the distal end of the reduced diameter portion. A pre-loading spring 24 is interposed between the stop ring 23 and the end surface of the inner ring 21. The spring 24 may be a helical spring as shown in FIGS. 3 and 4, or any other spring such as a disc spring or a leaf spring.

The balls 20*a*, 20*b* are equal in their diameter. The balls of ceramic material are higher in their hardness, and good at their abrasive resistance and durability.

The blower including a bearing of which the balls are of ceramic material can be used in high rotational speed, assuring the quietness thereof.

The assembling operation of the bearing device will be effected through the following steps; a plurality of balls 20*a* are disposed between the first inner raceway groove 19*a* formed around the shaft and the first outer raceway groove 19*b* formed within the sleeve, a plurality of balls 20*b* are disposed between the second inner raceway groove 22*a* formed around the inner ring and the second outer raceway groove 22*b* formed within the sleeve, then the pre-loading spring 24 is urged against the end face of the inner ring 21, and the stop ring 23 is secured to the reduced diameter portion 7*b* of the shaft with applying the pre-loading force due to the elastic force of the spring to the end face of the inner ring 21 in parallel to the axis of the shaft.

The blower in accordance with the first embodiment can be assembled easily in the following steps; attaching the stator 5 to the cylindrical bearing holder 4 of the base 3, fitting or securing the central hub 8*c* of the yoke 8 around which the impeller 10 is connected integrally therewith to the shaft 7 of the bearing device assembled as described above and applied thereto a suitable pre-load by the spring 24, and then fitting the sleeve 6 of the bearing apparatus into the cylindrical bearing holder 4 of the base 3 and bonded thereto.

As seen from the above, thus assembled blower does not require a conventional ball bearing including both inner and outer ring, so that the diameter of the larger diameter portion 7*a* of the shaft can be enlarged by the sum of the thickness of the inner and outer rings of the ball bearing, and the diameter of the reduced diameter portion 7*b* of the shaft can also be enlarged by the thickness of the outer ring of the ball bearing, i.e. generally thick shaft can be obtained.

Accordingly, the shaft of higher rigidity, good at durability, inhibited in its rotational run out, and superior quietness can be provided.

Although the bearing device of the present invention is a double row bearing device, it is unnecessary to employ a pair of ball bearings. This is because the single sleeve having the first and the second raceway grooves formed on the inner peripheral surface thereof will serve as outer rings of the ball bearings.

In other words, it is unnecessary to use two outer rings of the bearings other than the sleeve, and only one inner ring is required on the reduced diameter portion of the shaft.

Further, the pre-loading spring has been incorporated preliminary into the bearing so that the delicate and complicated operation required in the blower of the prior art for incorporating the pre-loading spring into the small space can be precluded.

The Second Embodiment

Figure 5:
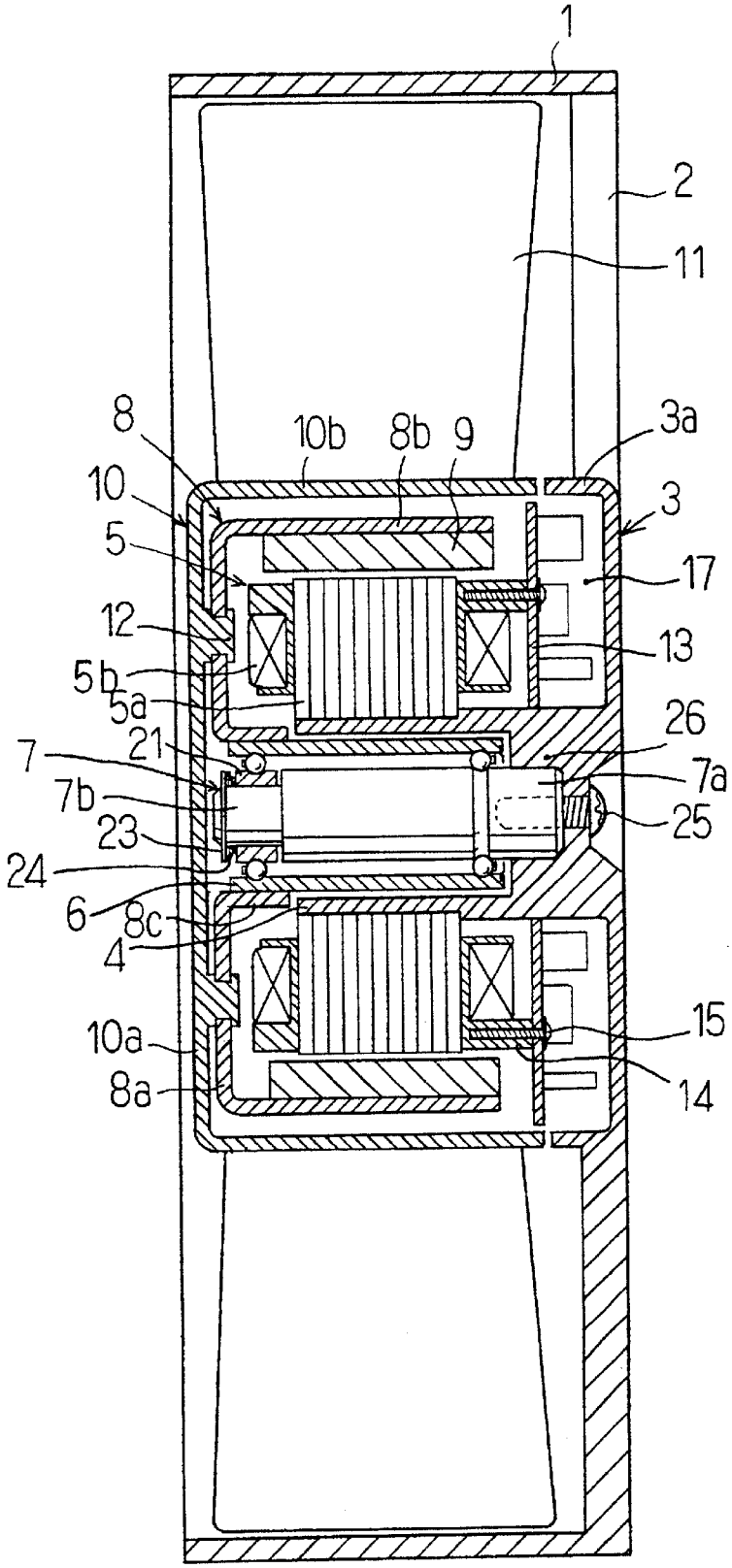
FIG. 5 is a longitudinal sectional view showing the second embodiment of the blower in accordance with the present invention.

The blower in accordance with this embodiment is a blower of a sleeve rotating type in which the shaft is stationary. The blower of this embodiment will now be described in detail with reference to FIG. 5.

The frame 1 is of substantially the same structure as that of the first embodiment and includes a base 3 positioned at the central portion of the frame. The base 3 has a cylindrical bearing holder 4 formed integrally therewith and extending frontward (i.e. leftward in FIG. 5) therefrom. A stator 5 including an iron core 5*a* and coils 5*b* is attached to the outer surface of the cylindrical bearing holder 4.

The bearing device including a sleeve 6, a shaft 7 and balls 20*a*, 20*b* interposed as double row therebetween is adapted to be inserted into the cylindrical bearing holder 4 in the reverse direction to that shown in FIG. 4. In this arrangement, the larger diameter portion 7*a* is inserted into a boss 26 of the base 3, and secured thereto by means of a machine screw 25. The outer diameter of the sleeve 6 is smaller than the inner diameter of the holder 4 so as to rotate within the holder 4.

The front end portion of the sleeve 6 is adapted to be inserted into a hub 8*c* for a central aperture provided through a front face plate 8*a* of a yoke 8, and secured thereto. The yoke 8 has at its periphery a rearward (i.e. rightward in FIG. 5) extending flange 8*b*, on the inner surface of which is provided with a magnet 9 corresponding to the stator 5.

The front face plate 8*a* of the yoke 8 is secured by any known means such as rivets 12 to a front face plate 10*a* of an impeller 10 having at its periphery a rearward extending flange 10*b*. The impeller 10 includes suitable numbers of blades 11 attached to the outer periphery of the flange.

In the blower of the above mentioned arrangement, energizing the coil of the stator rotates the yoke 8 together with the sleeve, and thus the impeller 10 connected to the yoke to provide a blow of wind by the blades 11.

The blower of this embodiment can be assembled easily in the following steps; attaching the stator 5 to the cylindrical bearing holder 4 of the base 3, fitting the sleeve 6 of the bearing device into the hub 8*c* of the yoke and secured thereto to connect the impeller to the bearing, inserting the sleeve 6 of the bearing device into the cylindrical bearing holder 4 of the base 3 so as to be concentric therewith, and securing the rear end of the shaft to the boss 26 of the base by means of the machine screw 25.

The Third Embodiment

Figure 6:
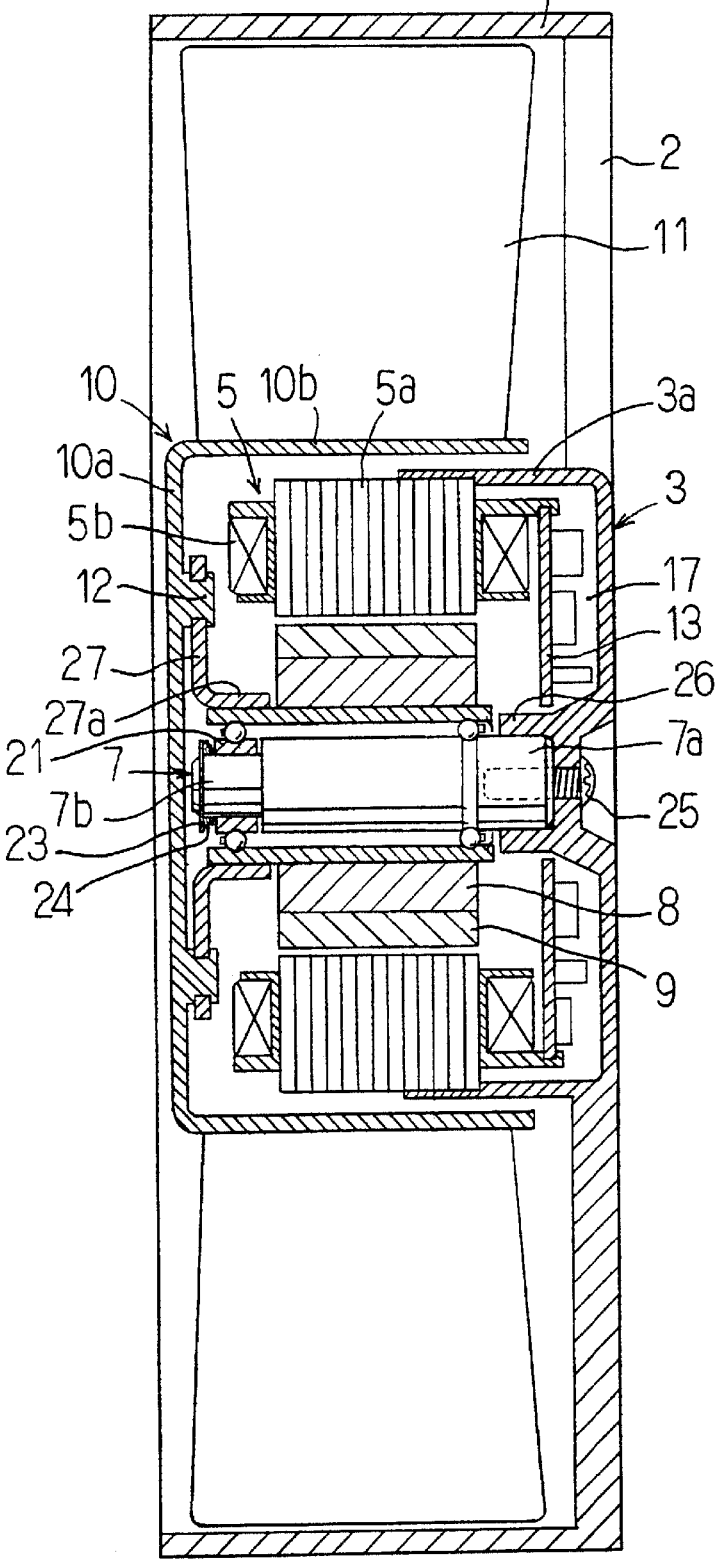
FIG. 6 is a longitudinal sectional view showing the third embodiment of the blower in accordance with the present invention.
Figure 7:
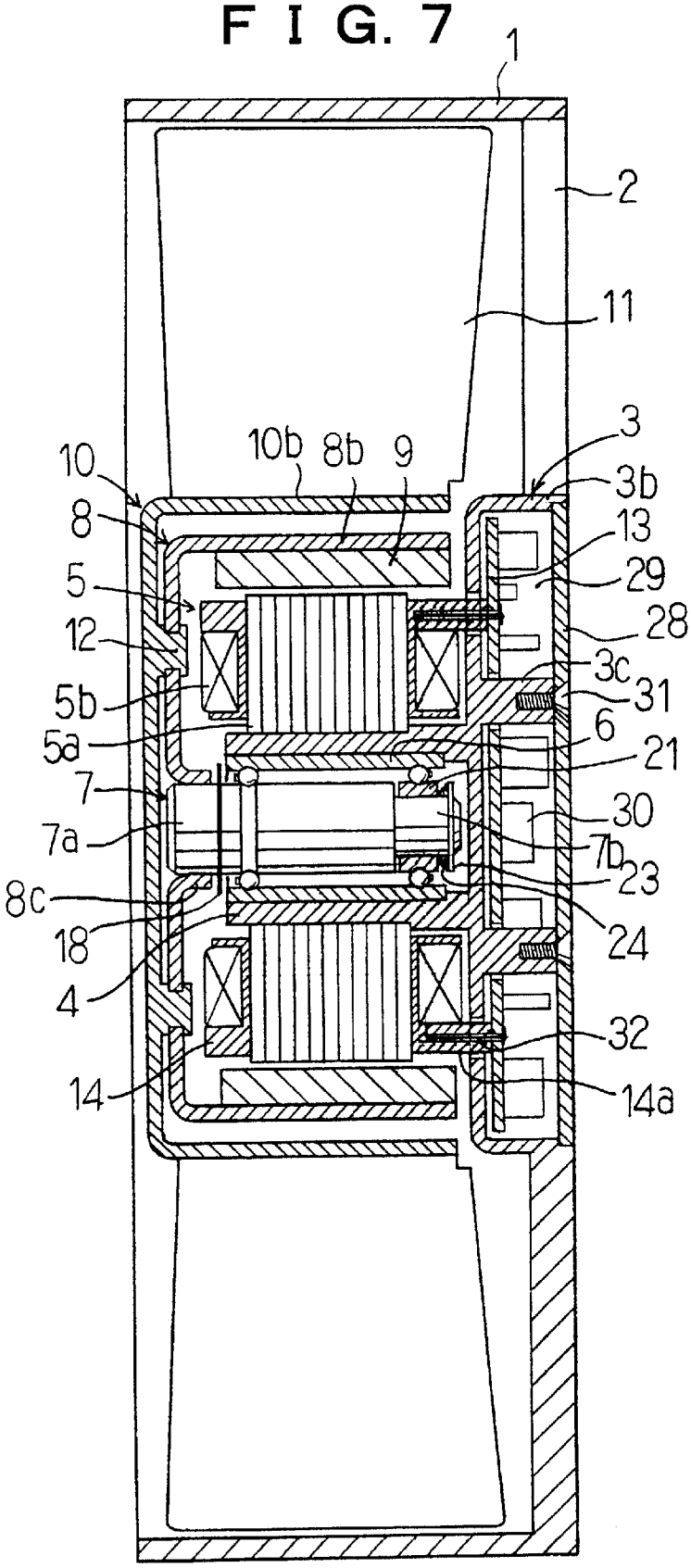
FIG. 7 is a longitudinal sectional view showing the third embodiment of the blower in accordance with the present invention.
Figure 8:
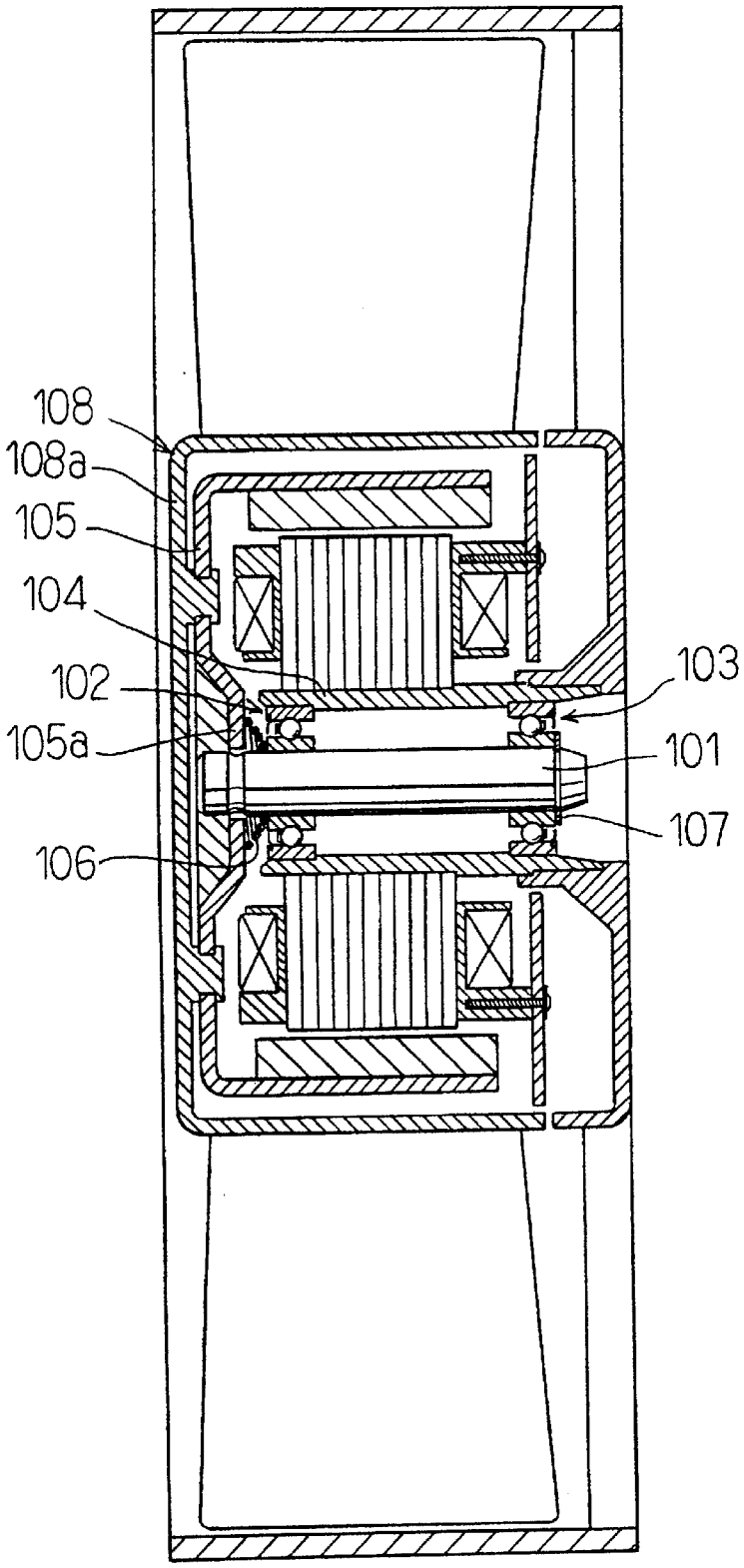
F I G. 8 Prior Art
FIG. 8 is a longitudinal sectional view showing an example of the blower of the prior art.
Figure 9:
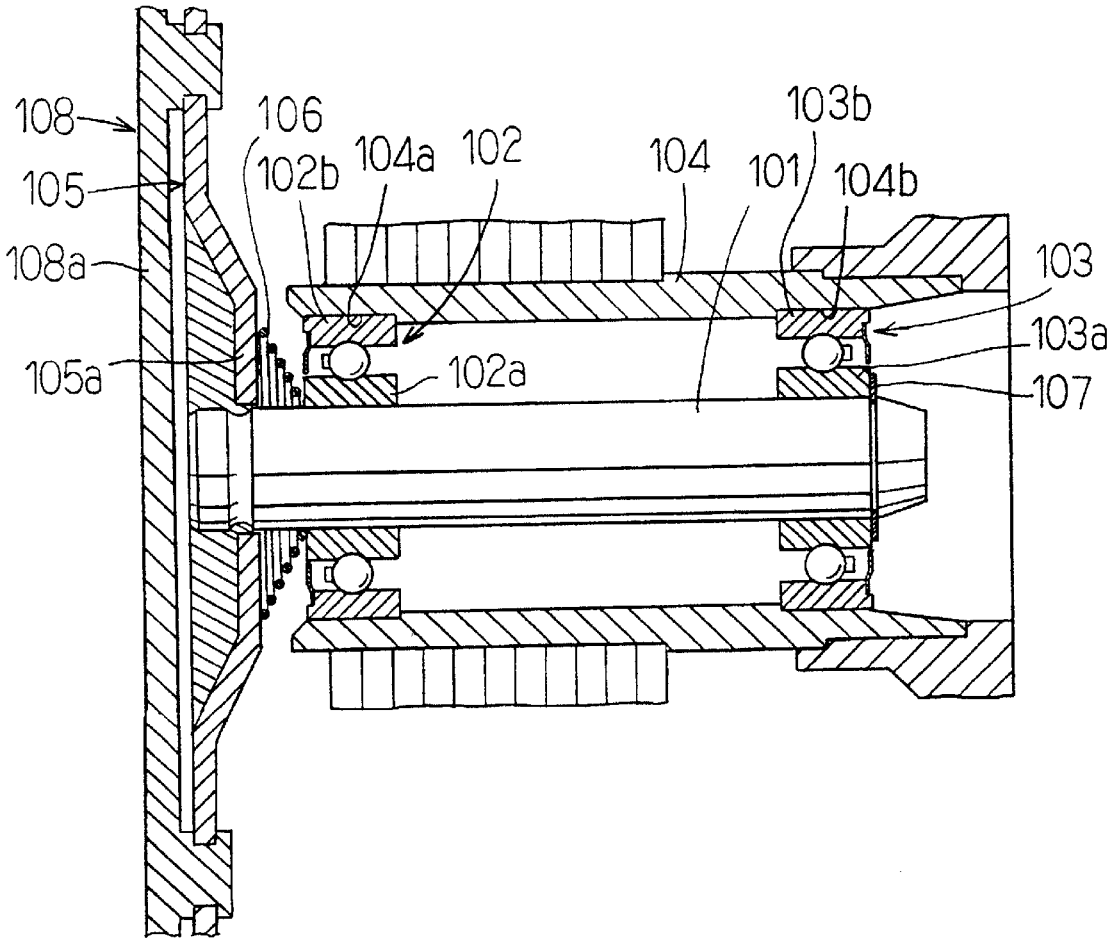
F I G. 9 Prior Art
FIG. 9 is an enlarged cross-sectional view showing the bearing device of the blower of the prior art.

The blower in accordance with this embodiment is also of the sleeve rotating type in which the shaft is stationary. The blower of this embodiment will now be described in detail with reference to FIG. 6.

The blower of this embodiment can be distinguished from those of the above mentioned embodiments in that the base 3 does not have the cylindrical bearing holder, the yoke is a cylindrical member, and the stator 5 is secured to the base.

The blower includes the stator attached to the inner peripheral surface of the flange 3*a* extending frontward from the base 3, and a magnet 9 connected to the annular yoke 8 fit around the exterior of the sleeve 6 of the bearing device of FIG. 4 and secured thereto. The outer periphery of the magnet 9 are spaced a distance from the inner peripheral surface of the stator 5.

The front end portion of the sleeve 6 is adapted to be inserted into the hub 27*a* for a central aperture provided through a supporting plate 27 and secured thereto. The supporting plate 27 is secured by any known means such as rivets 12 to a front plate portion 10*a* of an impeller 10.

In the blower of the above mentioned arrangement, energizing the coil of the stator rotates the yoke 8 together with the sleeve 6, and thus the impeller 10 connected to the sleeve through the supporting plate 27 to provide a blow of wind by the blades 11.

The blower of this embodiment can be assembled easily in the following steps; attaching the stator 5 to the flange 3*a* of the base, fitting the sleeve 6 into the hub 27*a* of the supporting plate 27 connected integrally to the impeller 10 and secured thereto, mounting the yoke 8 and the magnet 9 on the sleeve 6 to form a bearing apparatus, inserting thus obtained bearing device into the stator 5, and securing the rear end of the shaft to a boss 26 of the base 3 by means of a machine screw 25.

The Fourth Embodiment

The blower in accordance with this embodiment includes the base 3 having a flange 3*b* extending backward from the outer periphery thereof to form a cylindrical body with a bottom having an opening at the rear end thereof. The cylindrical body is occluded by a cover 28 to define a sealed chamber 29 for accommodating electric equipment. The accommodating chamber 29 is adapted to accommodate the electrical equipment such as a printed circuit board 13 or other electronic parts 30.

A plurality of internally threaded bosses 3*c* are extending backward (rightwards in the drawings) from the bottom of the base 3 to detachably mount the cover to the base 3 by engaging screws 31 extending through the cover 28 with the internal threads of the bosses.

The reference numeral 32 is added to leads for delivering electricity to the coil 5*b* of the stator 5 extend through legs 14*a* of the iron core holder 14 of the stator and connected to the printed circuit board 13.

The structure of the blower of this fourth embodiment is substantially the same as that of the first embodiment but for the fact that the chamber 29 is a sealed one.

The blower in accordance with the fourth embodiment is provided at the rear side of the base with a chamber for accommodating electrical equipment so that the printed circuit board or electronic parts can be protected from moisture, dirt, dusts, or other harmful gas or substance contained in a wind generated through the wind tunnel portion, and the degradation of the insulating property such as the electric insulation or dielectric strength can be avoided. Thus, the reliability of the blower or the equipment incorporated within the blower can be enhanced.

The Effects or Advantages

As seen from the above, the bearing apparatus of the blower in accordance with the present invention does not require a conventional ball bearing including both inner and outer rings, so that the diameter of the larger diameter portion of the shaft can be enlarged by the sum of the thickness of the inner and outer rings of the ball bearing, and the diameter of the reduced diameter portion of the shaft can also be enlarged by the thickness of the outer ring of the ball bearing, i.e. generally thick shaft can be obtained.

Accordingly, a shaft of higher rigidity, good at durability, inhibited in its rotational run out, and superior quietness can be provided.

Although the bearing device of the present invention is a double row bearing device, it is unnecessary to employ a pair of ball bearings. This is because the single sleeve having the first and the second outer raceway grooves formed on the inner peripheral surface thereof will serve as outer ring of the ball bearings.

In other words, it is unnecessary to use two outer rings of the bearings other than the sleeve, and only one inner ring is required on the reduced diameter portion of the shaft.

Further, the preliminary completed bearing apparatus in which a suitable amount of pre-loading force is applied by means of the pre-loading spring may be incorporated into the base or the rotor hub of the blower, since the pre-loading spring had been incorporated preliminary into the bearing device itself.

The delicate and complicated operation required in the assembling operation of the blower of the prior art for incorporating the pre-loading spring into the small space can be precluded so that the assembling operation of the blower can be effected easily and quickly.

Further, it is unnecessary to form lager inner diameter portions at the interior portions of both ends of the sleeve served also as the outer ring, so that the rotational run out caused by the eccentricity between the sleeve and the lager inner diameter portions and the generation of the noise accompanied therewith can be avoided.

While particular embodiments of the present invention have been illustrated and described, it should be obvious to those skilled in the art that various changes and modifications can be made without departing from the spirit and scope of the invention.

What is claimed is:

1. A blower having an impeller rotated upon energizing the blower comprising:

a bearing device for supporting a rotational center portion of the impeller, the bearing device including:

a sleeve, a stepped shaft including a larger diameter portion and a diameter portion provided at one end thereof, a first inner raceway groove formed around an outer peripheral surface of the larger diameter portion, a first outer raceway groove formed on an inner peripheral surface of the sleeve so as to correspond with said first inner raceway groove, balls of a first row interposed between the first inner and outer raceway grooves, an inner ring slidably fit over the reduced diameter portion, a second inner raceway groove formed around an outer peripheral surface of the inner ring, a second outer raceway groove formed on an inner peripheral surface of said sleeve so as to correspond with said second inner raceway groove, balls of a second row interposed between said second inner and outer raceway grooves, a stop ring provided around an outer periphery of a distal end of the reduced diameter portion, and a pre-loading spring interposed between the stop ring and an end surface of the inner ring to provide a pre-loading force to the inner ring.

2. A blower comprising:

a frame including a base connected through stays to the frame so as to be positioned at a central portion of said frame, a cylindrical bearing holder formed integrally with said base to extend therefrom, a stator including an iron core and a coil and mounted on the exterior of the cylindrical bearing holder, an impeller including a first front face plate, a first flange formed over an outer periphery of the first front face plate, and a plurality of blades provided on an outer periphery of said first flange, a yoke including a second front face plate to which the first front face plate of the impeller is secured, a second flange formed over an outer periphery of the second front face plate, a magnet mounted on the second flange, and a bearing device to which the central portion of said yoke is fit and secured thereto, the bearing device including:

a sleeve, a stepped shaft including a larger diameter portion and a reduced diameter portion provided at one end thereof, a first inner raceway groove formed around an outer peripheral surface of the larger diameter portion, a first outer raceway groove formed on an inner peripheral surface of the sleeve so ass to correspond with said first raceway groove, balls of a first row interposed between said first inner and outer raceway grooves, an inner ring slidably fit over the reduced diameter portion, a second inner raceway groove formed around an outer peripheral surface of the inner ring, a second outer raceway groove formed on an inner peripheral surface of the sleeve so as to correspond with said second inner raceway groove, balls of a second row interposed between the second inner and outer raceway grooves, a stop ring provided around an outer periphery of a distal end of the reduced diameter portion, and a pre-loading spring interposed between the stop ring and an end surface of the inner ring to provide a pre-loading force to the inner ring.

3. A blower comprising:

a frame including a base connected through stays to said frame so as to be positioned at a central portion of said frame, a cylindrical bearing holder formed integrally with said base to extend therefrom, a stator including an iron core and a coil and mounted on the exterior of the cylindrical bearing holder, an impeller including a first front face plate, a first flange formed over outer periphery of said first front face plate, and a plurality of blades provided on an outer periphery of the first flange, a yoke including a second front face plate to which said first front face plate of said impeller is secured, a second flange formed over an outer periphery of the second front face plate, a magnet mounted on the second flange, and a bearing device for supporting a central portion of the yoke through a sleeve of said bearing device to which the central portion of the yoke is fit and secured thereto, said bearing device including:

a sleeve, stepped shaft including a larger diameter portion and a reduced diameter portion provided at one end thereof, a first inner raceway groove formed around an outer peripheral surface of the larger diameter portion, a first outer raceway groove formed on an inner peripheral surface of the sleeve so as to correspond with the first inner raceway groove, balls of a first row interposed between the first inner and outer raceway grooves, an inner ring slidably fit over the reduced diameter portion, a second inner raceway grove formed around an outer peripheral surface of the inner ring, a second outer raceway groove formed on an inner peripheral surface of the sleeve so as to correspond with said second inner raceway groove, balls of a second row interposed between said second inner and outer raceway grooves, a stop ring provided around an outer periphery of a distal end of the reduced diameter portion, and a pre-loading spring interposed between the stop ring and an end surface of the inner ring to provide a pre-loading force to the inner ring.

4. A blower comprising:

a frame including a base connected through stays to the frame so as to be positioned at a central portion of the frame, a cylindrical bearing holder formed integrally with said base to extend therefrom, a stator including an iron core and a coil and mounted on the exterior of the cylindrical bearing holder, an impeller including a first front plate, a first flange formed over an outer periphery of the first front face plate, and a plurality of blades provided on an outer periphery of the first flange, a yoke including a second front face plate to which the first front face plate of the impeller is secured, a second flange formed over an outer periphery of the second front face plate, a magnet mounted on the second flange, and a bearing device for supporting a central portion of the yoke through a sleeve thereof to which the central portion of the yoke is fit and secured thereto, the bearing device including:

a sleeve, a steeped shaft including a larger diameter portion and a reduced diameter portion provided at one end thereof, a first inner raceway groove formed around an outer peripheral surface of the larger diameter portion, a first outer raceway groove formed on an inner peripheral surface of the sleeve so as to correspond with said first inner raceway groove, balls of a first row interposed between said first inner and outer raceway grooves, an inner ring slidably fit over the reduced diameter portion, a second inner raceway groove formed around an outer peripheral surface of the inner ring, a second outer raceway groove formed on an inner peripheral surface of said sleeve so as to correspond with said inner raceway groove, balls of a second row interposed between said second inner and outer raceway grooves, a stop ring provided around an outer periphery of a distal end of the reduced diameter portion, and a pre-loading spring interposed between the stop ring and an end surface of the inner ring to provide a pre-loading force to the inner ring, wherein the bearing device is provided within the cylindrical bearing holder so that the sleeve can be rotated around an axis of the bearing device, and an end of the shaft is secured to the base.

5. A blower comprising:

a frame including a base connected through stays to the frame so as to be positioned at a central portion of the frame, a stator including an iron core and a coil and mounted on an inner peripheral surface of a first flange extending forwardly from an outer periphery of the base, an impeller including a front face plate, a second flange formed over an outer periphery of the front face plate, and a plurality of blades provided on an outer periphery of the second flange, a bearing device for supporting a central portion of a supporting plate mounted on a rear surface of said front face plate, the bearing device including:

a sleeve to which the central portion of the supporting plate is fit and secured, a stepped shaft including a larger diameter portion and a reduced diameter portion provided at one end thereof, a first inner raceway groove formed around an outer peripheral surface of the larger diameter portion, a first outer raceway groove formed on an inner peripheral surface of the sleeve so as to correspond with said first inner raceway groove, balls of a first row interposed between said first inner and outer raceway grooves, an inner ring slidably fit over the reduced diameter portion, a second inner raceway groove formed around an outer peripheral surface of the inner ring, a second outer raceway groove formed on an inner peripheral surface of said sleeve so as to correspond with said second inner raceway groove, balls of a second row interposed between said second inner and outer raceway grooves, a stop ring provided around an outer periphery of a distal end of the reduced diameter portion, and a pre-loading spring interposed between said stop ring and an end surface of said inner ring to provide a pre-loading force to the inner ring, wherein an exterior of the sleeve of the bearing apparatus is provided with a cylindrical yoke on which is provided a magnet corresponding a magnet corresponding to said coil of said stator, and an end of said shaft is secured to the base.

6. A blower according to claim 1, wherein said balls of the first row and second row are made of ceramic material.

7. A blower according to claim 2, wherein said balls of the first row and second row are made of ceramic material.

8. A blower according to claim 3, wherein said balls of the first row and second row are made of ceramic material.

9. A blower according to claim 4, wherein said balls of the first row and second row are made of ceramic material.

10. A blower according to claim 5, wherein said balls of the first row and second row are made of ceramic material.

11. A blower according to claim 1, wherein an outer diameter of said inner ring is the same as a diameter of the larger diameter portion of said shaft, and a diameter of said balls for the first row is the same as a diameter of said balls for the second row.

12. A blower according to claim 2, wherein an outer diameter of said inner ring is the same as a diameter of the larger diameter portion of said shaft, and a diameter of said balls for the first row is the same as a diameter of said balls for the second row.

13. A blower according to claim 3, wherein an outer diameter of said inner ring is the same as a diameter of the larger diameter portion of said shaft, and a diameter of said balls for the first row is the same as a diameter of said balls for the second row.

14. A blower according to claim 4, wherein an outer diameter of said inner ring is the same as a diameter of the larger diameter portion of said shaft, and a diameter of said balls for the first row is the same as a diameter of said balls for the second row.

15. A blower according to claim 5, wherein an outer diameter of said inner ring is the same as a diameter of the larger diameter portion of said shaft, and a diameter of said balls for the first row is the same as a diameter of said balls for the second row.

* * * * *